US006257237B1

(12) United States Patent
Suzuki

(10) Patent No.: US 6,257,237 B1
(45) Date of Patent: Jul. 10, 2001

(54) CUSHION STRUCTURE FOR NURSING EQUIPMENT

(75) Inventor: Sachiyo Suzuki, Osaka (JP)

(73) Assignee: Aprica Kassai Kabushikikaisha, Osaka (JP)

( * ) Notice: Subject to any disclaimer, the term of this patent is extended or adjusted under 35 U.S.C. 154(b) by 0 days.

(21) Appl. No.: 09/229,516

(22) Filed: Jan. 13, 1999

(30) Foreign Application Priority Data

Jan. 13, 1998 (JP) ..... 10-004750

(51) Int. Cl.[7] ..... A61F 13/00
(52) U.S. Cl. ..... 128/846; 297/452.22; 5/454
(58) Field of Search ..... 128/845, 846, 128/869, 870; 5/636, 637, 638, 639, 655; 297/452.55, DIG. 1

(56) References Cited

U.S. PATENT DOCUMENTS 5,086,514 * 2/1992 Ross ..... 2/2
5,444,881 * 8/1995 Landi ..... 5/454
5,675,853 * 10/1997 Linge ..... 5/655
5,722,729 * 3/1998 Carilli ..... 297/452.55

FOREIGN PATENT DOCUMENTS 56-101065 8/1981 (JP) .
60-75012 4/1985 (JP) .
60-95051 6/1985 (JP) .
63-93859 6/1988 (JP) .
3-78405 8/1991 (JP) .

OTHER PUBLICATIONS

"Ikuji No Genri" (Principle of Child Bearing), by Dr, Jushichiro Naito (Related Part of an English Language Brochure).

* cited by examiner

*Primary Examiner*—Michael A. Brown
(74) *Attorney, Agent, or Firm*—W. F. Fasse; W. G. Fasse

(57) ABSTRACT

A cushion structure for a nursing equipment such as a child seat includes a soft third cushion layer which has a low density, hard second and fourth cushion layers which have a high density provided on opposite sides of the third cushion layer, and soft first and fifth cushion layers which have a low density. The third cushion layer has an air pool therein, and air outlet holes are provided in the second and fifth cushion layers at positions displaced from the center of the air pool and offset from each other. This cushion structure can protect the head and brain of an infant by effectively absorbing shock.

15 Claims, 9 Drawing Sheets

CUSHION STRUCTURE FOR NURSING EQUIPMENT

BACKGROUND OF THE INVENTION

1. Field of the Invention

The present invention relates to a cushion structure for a nursing equipment such as a child seat and, more specifically, to a cushion structure for a nursing equipment capable of fully protecting the brain of an infant.

2. Description of the Background Art

Healthy and sound growth of infants and babies is a common wish of parents worldwide. The first to third years, especially the second year for a baby is a critical period when the baby comes to be aware of his or her self. Therefore, it is recognized that protection of the head (brain) of the infant of this age is of importance for sound and healthy growth of the infant.

The head (brain) may be protected by "proper nursing method" and "use of proper nursing equipment." Here, "proper nursing method" means proper parental care of the infant as described in detail in, for example, IKUJI NO GENRI (Principle of Child Bearing), by Dr. Jushichiro Naito.

"Proper nursing equipment" refers to a nursing equipment having such a structure that is capable of sufficiently protecting the head (brain) of an infant, as already described. More specifically, the equipment must have a structure for protecting the brain of an infant sufficiently against external shock. Though various and many nursing equipments have been developed to this date, unfortunately, a nursing equipment having such a structure that can sufficiently protect the head (brain) of an infant cannot be found at present.

Cushion structures employed in a chair, a vehicular seat, sandals and the like are disclosed in Japanese Utility Model Laying-Open Nos. 56-101065, 60-95051, 63-93859 and 3-78405. The structures disclosed in these references, however, are all proposed for improved air ventilation.

Therefore, such structures cannot be used as a structure for protecting the head (brain) of an infant sufficiently against an external shock.

SUMMARY OF THE INVENTION

An object of the present invention is to provide a proper nursing equipment for assisting healthy and sound growth of an infant and, more specifically, to provide a cushion structure of a nursing equipment which can sufficiently protect the head (brain) of the infant against external shock.

The above described objects of the present invention can be attained by a cushion structure or a nursing equipment in accordance with one aspect of the present invention which includes an air pool consisting of a prescribed space, and a shock absorbing region provided surrounding the air pool for absorbing shock by allowing leakage of air from the air pool when the air pool is deformed by the shock.

Preferably, the shock absorbing region includes an outlet hole communicated with the air pool. Preferably, the shock absorbing region includes a cut out communicated with the air pool. Preferably, the shock absorbing region is formed of a porous material surrounding the air pool.

Preferably, the shock absorbing region is formed of a layer of porous material provided surrounding the air pool.

Because of this structure, even when the head (brain) of an infant hits against the nursing equipment upon external shock, the shock can be received at first by the air pool.

Further, as the air pool is deformed by the shock, the air in the air pool leaks to the shock absorbing region, and therefore the shock can be absorbed at a moment, not transmitted to the head (brain) of the infant.

The above described objects of the present invention are attained by the cushion structure for a nursing equipment in accordance with another aspect of the present invention which is a cushion structure for a nursing equipment supporting an infant from behind, including a first cushion layer, a second cushion layer positioned behind the first cushion layer, and a third cushion layer positioned behind the second cushion layer. The second cushion layer has an air pool consisting of a prescribed space.

As this structure is adopted, when the air pool provided in the second cushion layer is deformed by a shock, the air in the air pool leaks out to the first and third cushion layers, and hence the shock can be absorbed.

Further, density of a member constituting the second cushion layer is adopted to be smaller than the densities of members constituting the first and third cushion layers.

Preferably, the second cushion layer is made softer than the first and third cushion layers.

As this structure is adopted, the second cushion layer deforms to a greater extent than the first and third cushion layers against a shock, and therefore the shock can more effectively be absorbed at a moment, and the shock is not transmitted to the head (brain) of the infant.

Preferably, at least one of the first and third cushion layers has an outlet hole communicated with the air pool.

As this structure is adopted, the air in the air pool can leak out from the outlet hole provided in the first or third cushion layer. Therefore, the shock can be absorbed more effectively at a moment, and the shock is not transmitted to the head (brain) of the infant.

Preferably, the outlet hole is provided at a position apart from a central region of the air pool.

As this structure is adopted, when there is an external shock, the central portions of the first and third cushion layers sandwiching the air pool from both sides deform most. If the outlet hole is provided near the central portion of the air pool, the air in the air pool leaks abruptly, and hence the effect of gradual shock absorption cannot be attained.

When the outlet hole is provided at a position off from the center of the air pool as described above, it becomes possible to gradually let out the air in the air pool when there is a shock. As a result, it becomes possible to let out the air in the air pool upon any shock at a most efficient speed for absorbing the shock. Accordingly, the shock can be absorbed efficiently in a minimum time period.

Preferably, the first and third cushion layers have outlet holes communicated with the air pool, the outlet holes being provided at positions off from the central region of the air pool, and the positions of the first and third cushion layers are offset from each other.

As this structure is adopted, it becomes possible to let out the air in the air pool when there is a shock, at a speed most efficient for absorbing the shock, and therefore the shock can be absorbed more efficiently in a minimum time period.

Preferably, the cushion structure further has a fourth cushion layer softer than the first cushion layer, on that surface of the first cushion layer which faces the infant.

This structure is agreeable to the touch of the infant, providing comfortable environment for the infant.

Preferably, the structure has a fifth cushion layer on a back surface of the third cushion layer, and density of a member constituting the fifth cushion layer is set lower than the density of the member constituting the third cushion layer.

By this structure, it becomes possible to let the air out from the air pool through the outlet hole and further through the fifth cushion layer having low density. This enables more effective absorption of the shock.

Preferably, there are a plurality of the air pools and a plurality of the outlet holes, with the air pools and outlet holes provided at positions supporting the head of the infant.

Accordingly, it becomes possible to absorb any shock at a moment so that the shock is not transmitted to the head (brain) of the infant, and to surely protect the head (brain) of the infant. As a result, a proper nursing equipment for the infant is provided.

The above described objects of the present invention can be attained by the cushion structure for a nursing equipment in accordance with a still further aspect of the present invention which has first, second, third and fourth layers in this order from the side facing the infant, with the densities of members constituting the first, second, third and fourth layers being set such that the densities of the first and third layers are higher than those of the second and fourth layers. Preferably, the structure further has a fifth layer on a back surface of the fourth layer, with the density of the member constituting the fifth layer being set lower than the density of the member constituting the fourth layer.

As this structure is adopted, the first layer which touches the infant has low density, and therefore it is soft and agreeable to the touch of the infant, providing comfortable environment for the infant. Even when the head (brain) of the infant hits the nursing equipment because of an external shock, the first, third and fifth layers deform greater as the first, third and fifth layers have lower density than the second and fourth layers, and therefore the shock can be absorbed at a moment without being transmitted to the head (brain) of the infant.

The foregoing and other objects, features, aspects and advantages of the present invention will become more apparent from the following detailed description of the present invention when taken in conjunction with the accompanying drawings.

Figure 1:
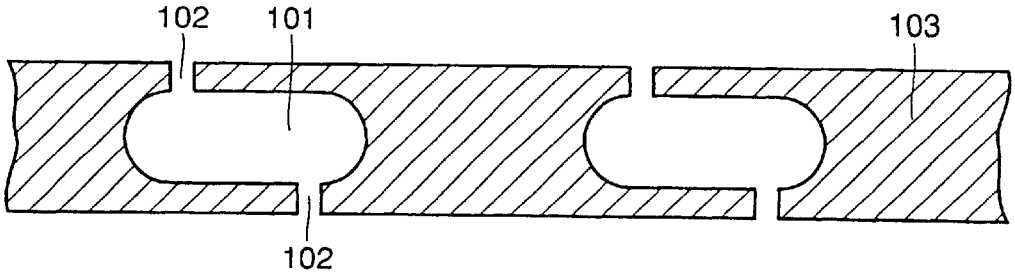
FIGS. 1 to 4 are cross sectional views showing first to fourth cushion structures illustrating a principle of shock absorption in accordance with the present invention.

DESCRIPTION OF THE PREFERRED EMBODIMENTS (principle of Shock Absorption)

The principle of shock absorption in accordance with the present invention will be described with reference to FIG. 1. In the cushion structure for absorbing shock in accordance with the present invention, there are air pools 101 consisting of spaces, and outlet holes 102 communicating with the air pools 101, provided at prescribed positions of a cushion member 103. When the head (brain) of an infant hits the cushion structure upon any shock, in the cushion structure, air pool 101 temporarily receives the shock. Based on the deformation of air pool 101 caused by the shock, the air in air pool 101 leaks out through outlet hole 102. Therefore, the shock can be absorbed at a moment by the deformation of air pool 101, without transmitting the shock to the head (brain) of the infant.

Further, the outlet holes 102 are provided at positions off from the central region of air pool 101, and positions of outlet holes are offset from each other. Therefore, when there is any shock, the air in air pool 101 is leaked out not abruptly but the air in air pool 101 is leaked out at a speed most efficient for absorbing the shock.

Here, the shock is absorbed by letting out the air in the air pool 101 from outlet hole 102. Therefore, outlet hole 102 serves as a shock absorbing region.

Figure 2:
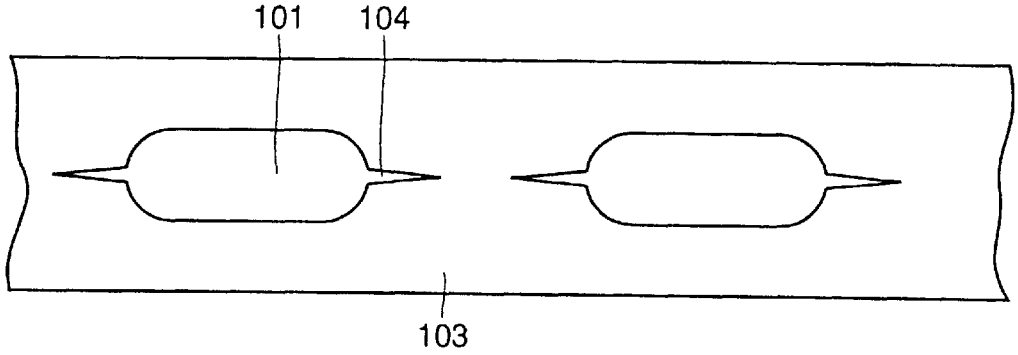

The cushion structure serving as a shock absorbing region by leaking out the air in air pool 101 through outlet hole 102 is not limited to the structure shown in FIG. 1. In place of the outlet holes 102 shown in FIG. 1, cut outs 104 may be provided as shown in FIG. 2, so that the cut outs 104 are opened as air pool 101 deforms, to which open regions, the air of air pools 101 leaks out.

Figure 3:
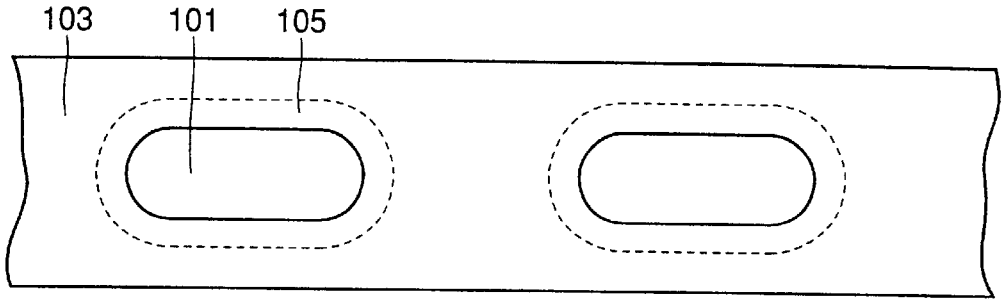

Further, as shown in FIG. 3, porous member 105 may be arranged around air pool 101, so that the air from air pool 101 leaks out to this region, when the air pool 101 is deformed.

Figure 4:
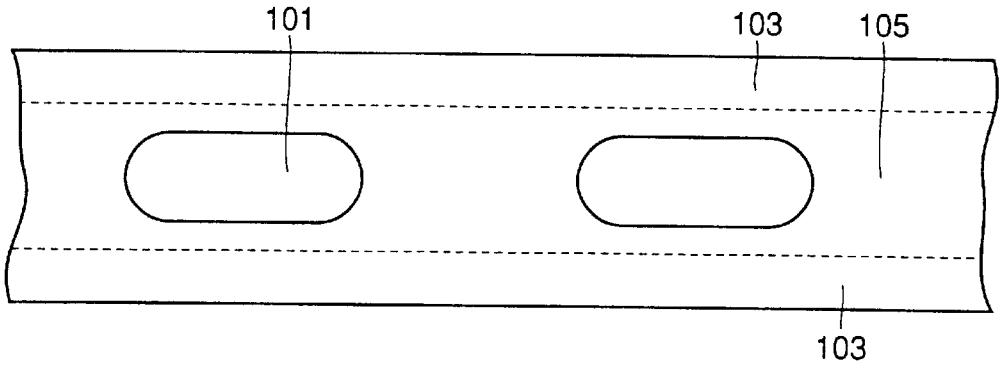

Further, a layer of porous member 105 may be arranged surrounding air pool 101 as shown in FIG. 4, so that the air from air pool 101 may be leaked out to this region when air pool 101 is deformed.

By this structure, even when the head (brain) of an infant hits the nursing equipment because of external shock, the shock is temporarily received by air pool 101. Further, the air in air pool 101 leaks out to the shock absorbing region as air pool 101 deforms by the shock, and therefore the shock can be absorbed at a moment and not transmitted to the head (brain) of the infant.

(Embodiments)

Embodiments of the present invention will be described in the following with reference to the figures.

Figure 5:
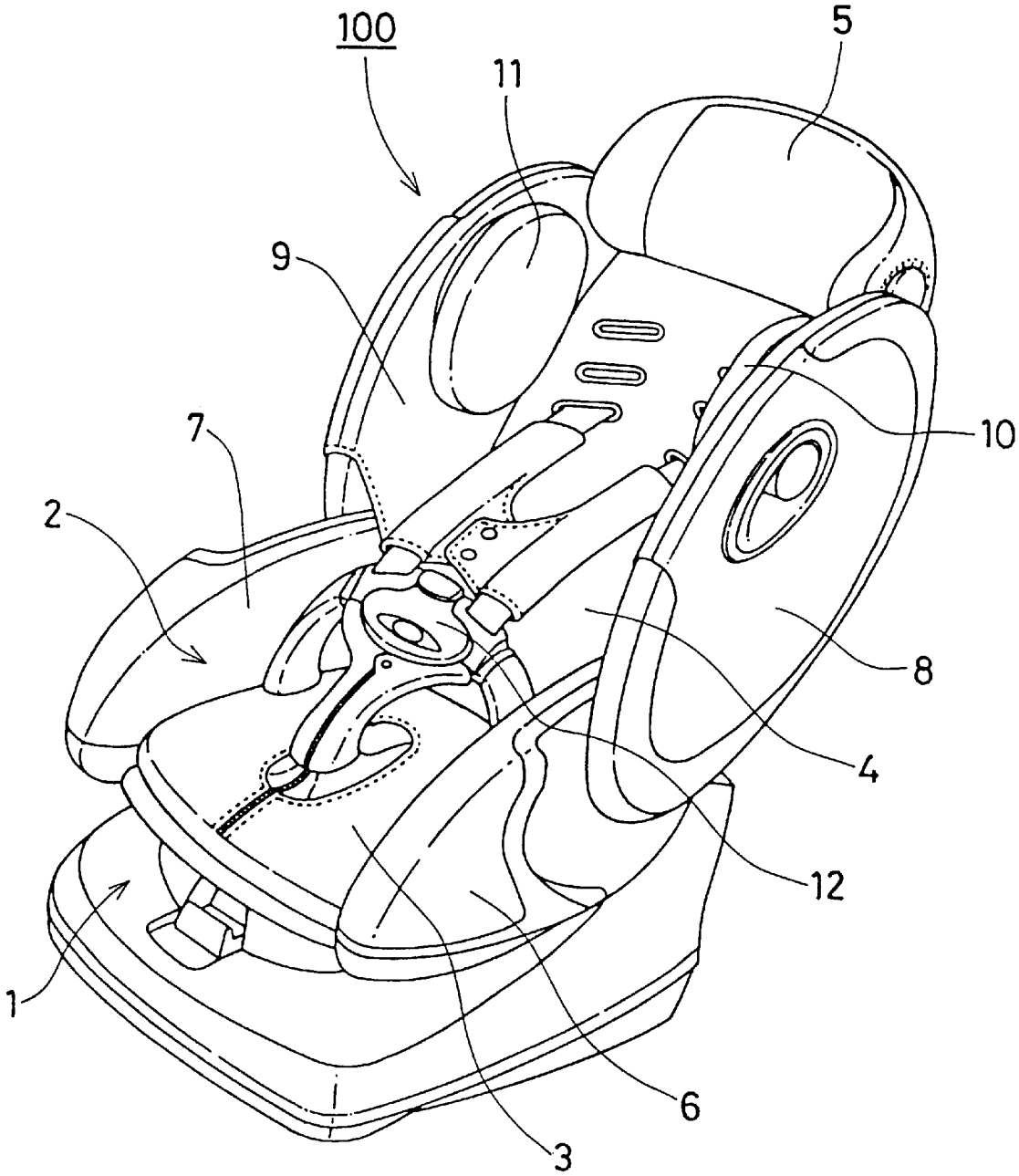
FIG. 5 is a perspective view showing a structure of a vehicular child safety seat to which the cushion structure of the present invention is applied.

FIG. 5 is a perspective view showing a structure of a vehicular child safety seat to which the cushion structure of the nursing equipment in accordance with the present invention is applied.

Referring to FIG. 5, the structure of vehicular child safety seat 100 will be described briefly. The vehicular child safety seat 100 includes a base 1 which is fixed by a safety belt (not shown) on the vehicle, and a seat apparatus 2 rotatably supported relative to base 1.

The seat apparatus 2 includes a seat 3 for supporting an infant, a backrest 4 coupled to and allowing reclining with respect to the seat 3, and a head guard 5 for protecting the top head portion of an infant when the backrest 4 is fully reclined backward.

A pair of arm rests 6 and 7 are provided on opposing sides of seat 3, and a pair of side guards 8 and 9 are provided on opposing sides of backrest 4. Inside the pair of side guards 8 and 9, support guards 10 and 11 for holding or supporting side portions of the head of an infant are provided.

Detailed structure of head guard 5 to which the cushion structure in accordance with the present invention is applied in the vehicular child safety seat 100 structured as above will be described with reference to FIGS. 6 to 9.

Figure 6:
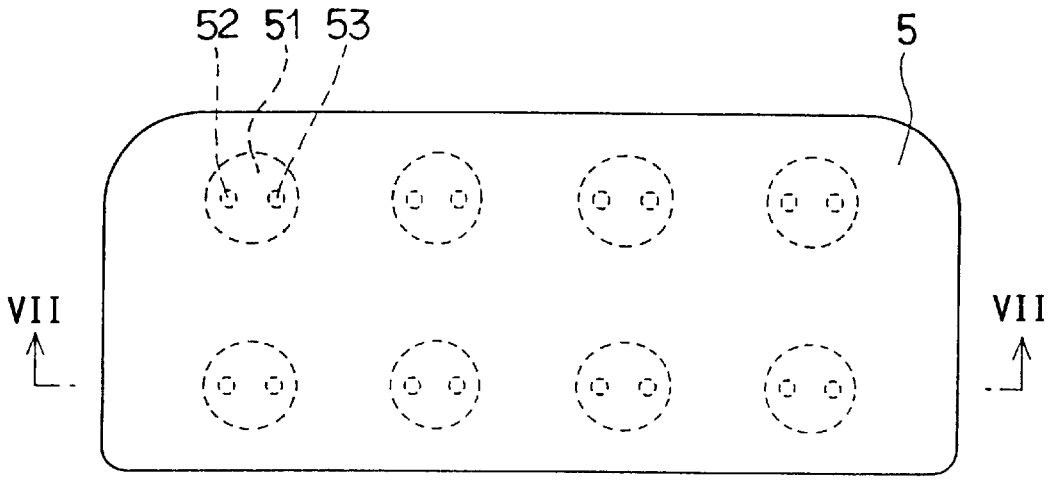
FIG. 6 a plan view of a head guard employing the cushion structure of the present invention.
Figure 7:
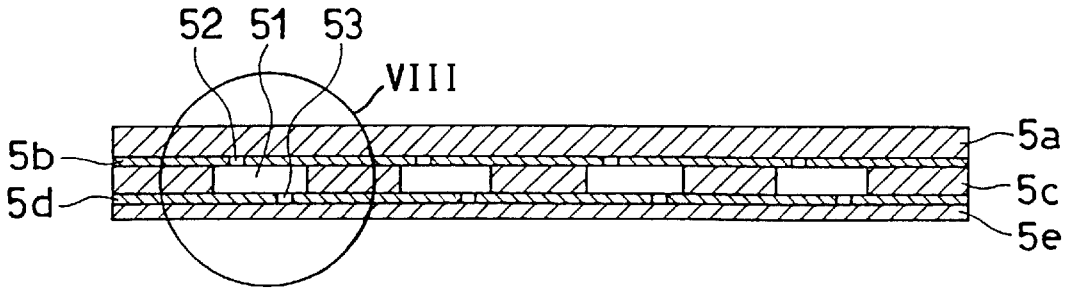
FIG. 7 is a cross sectional view taken along the line VII—VII of FIG. 6.
Figure 8:
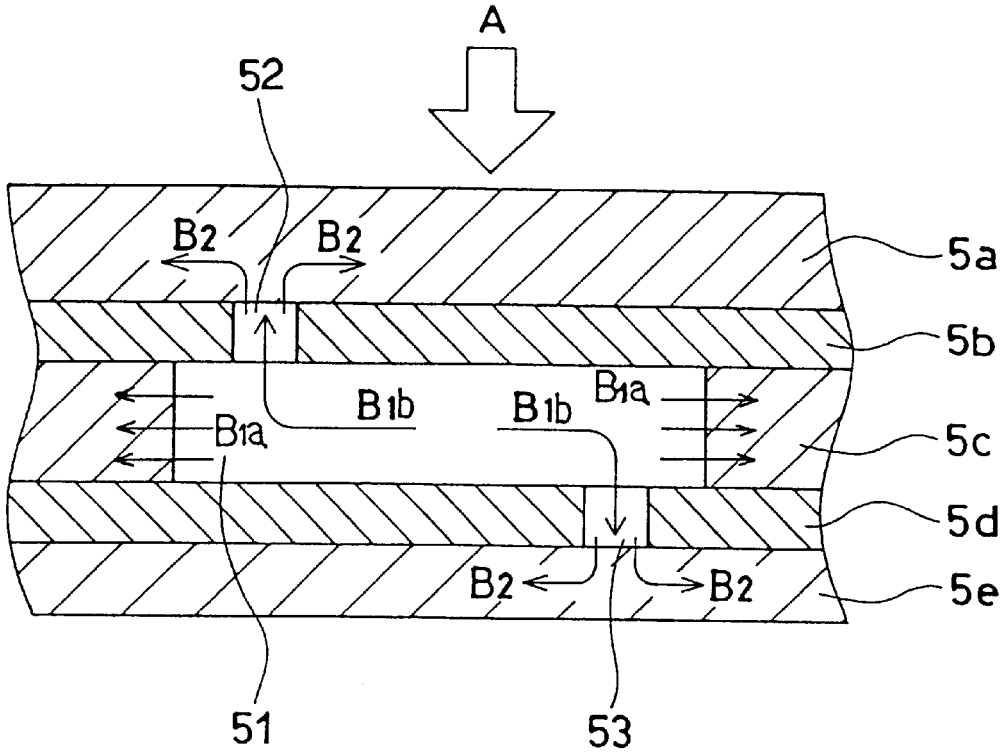
FIG. 8 is an enlarged cross section of a region surrounded by the circle VIII of FIG. 7.

FIG. 6 is a plan view of the head guard 5, FIG. 7 is a cross section viewed from the line VII—VII of FIG. 6, and FIG. 8 is an enlarged cross section of the region surrounded by a circle VIII of FIG. 7.

Head guard 5 has a 5-layered cushion structure including first to fifth cushion layers 5*a*, 5*b*, 5*c*, 5*d*, and 5*e*. The second and fourth cushion layers 5*b* and 5*d* are provided sandwiching, from the front and rear sides, the third cushion layer 5*c*. The first and fifth cushion layers 5*a* and 5*e* are provided to sandwich the second and fourth cushion layers 5*b* and 5*d*.

Densities of members constituting the first, third and fifth cushion layers 5*a*, 5*c* and 5*e* are selected to be smaller than the densities of the members of the second and fourth cushion layers 5*b* and 5*d*. Further, the first, third and fifth cushion layers 5*a*, 5*c* and 5*e* are preferably softer than the second and fourth cushion layers 5*b* and 5*d*.

Thus, a porous member of polyurethane foam is used for the first, third and fifth cushion layers 5*a*, 5*c* and 5*e*, while a porous member of polyethylene foam is used for the second and fourth cushion layers 5*b* and 5*d*.

Further, a plurality of air pools 51 consisting of prescribed spaces are provided at prescribed positions in the third cushion layer 5*c* as shown in FIGS. 6 and 7. Further, outlet holes 52 and 53 communicated with the air pools 51 are provided in the second and fourth cushion layers 5*b* and 5*d*.

Here, outlet holes 52 and 53 are provided away from the center of air pool 51, and outlet holes 52 and 53 are also provided offset from each other. Outlet holes 52 and 53 are so arranged as to let out the air of air pool 51 not abruptly to the outside upon any shock but at a speed most efficient for absorbing the shock, as already described with reference to FIG. 1.

The principle of shock absorption by air pool 51 and outlet holes 52 and 53 in the 5-layered cushion structured will be described with reference to FIG. 8. In the cross sectional structure shown in FIG. 8, the upper side is the side facing an infant. Though not shown, it is assumed that there is a base member for supporting the 5-layered cushion structure on the lower side.

First, when there is a shock from the outside (in the direction represented by the arrow A in the figure), the shock is softened by the soft first and fifth cushion layers 5*a* and 5*e*. Thereafter, the shock is temporarily received by the hard second and fourth cushion layers 5*b* and 5*d*.

Then, by the shock applied to the second and fourth cushion layers 5*b* and 5*d*, the third cushion layer 5*c* is much compressed. At this time, air pool 51 provided in the third cushion layer 5*c* deforms considerably, so that the air in air pool 51 flows out to the inside of the third cushion layer 5*c* as represented by arrow B1*a* in the figure.

Here, as a preferable structure, there are a plurality of air pools 51. Therefore, it is possible that air flowing out from adjacent air pools 51 finds no way out inside the third cushion layer 5*c*. Therefore, it is preferred that outlet holes 52 and 53 are provided for effectively letting out the air from air pool 51 to the outside as represented by the arrows B1*b* in the figure.

The air flowing out from outlet holes 52 and 53 flow out to soft first and fifth cushion layers 5*a* and 5*e* as represented by the arrow B2 in the figure. As a result, the air from air pool 51 flows out through the inside of the third cushion layer 5*c*, outlet holes 52 and 53, and inside of the first and fifth cushion layers 5*a* and 5*e*, so that the shock is absorbed gradually. Accordingly, the shock can be absorbed efficiently with minimum speed.

Figure 9:
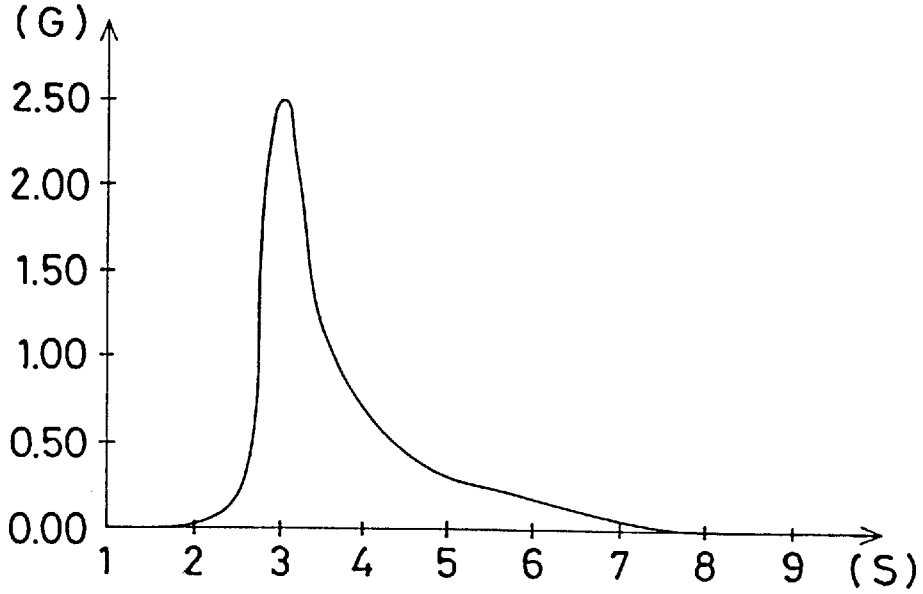
FIG. 9 PRIOR ART
FIG. 9 is a graph of shock absorption by a single layer cushion structure.
Figure 10:
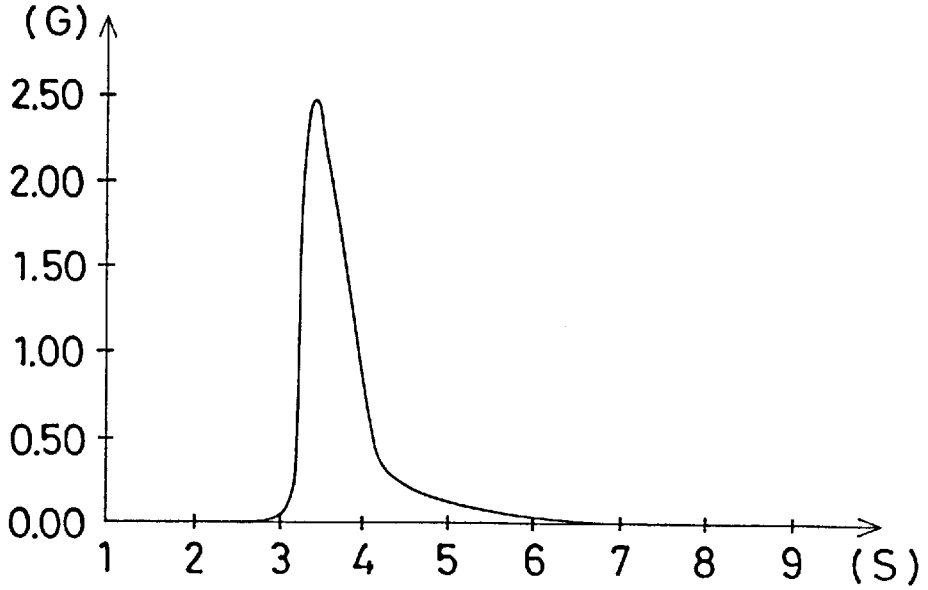
FIG. 10 is a graph showing shock absorption by a 3-layered cushion structure.
Figure 11:
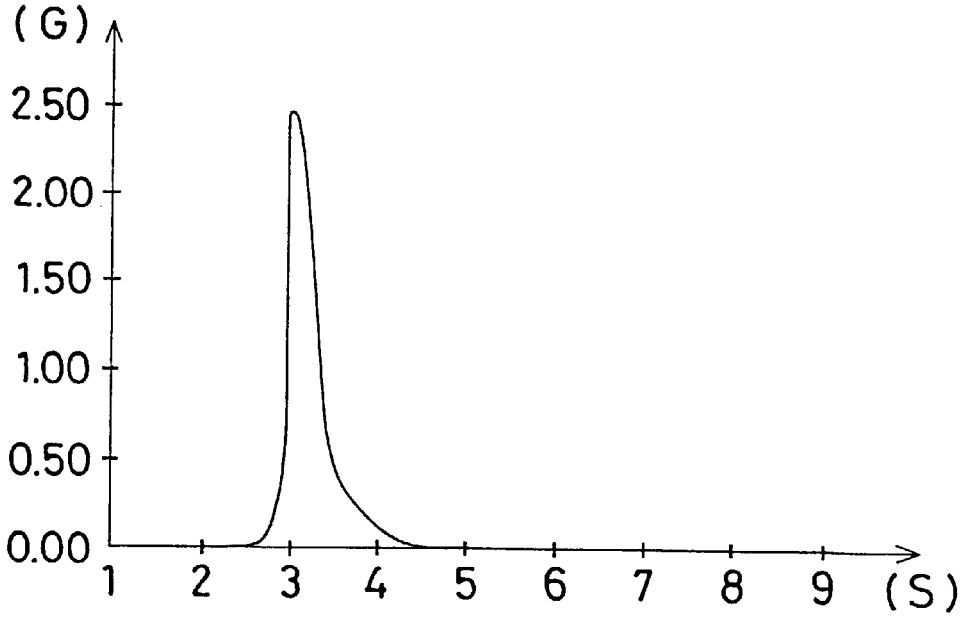
FIG. 11 is a graph showing shock absorption by a 5-layered cushion structure in accordance with the present invention.

FIG. 9 shows shock absorption of a conventional single layered cushion structure, FIG. 10 shows shock absorption by a 3-layered cushion structure including a soft urethane, a less soft urethane and hard urethane from the surface side, and FIG. 11 shows shock absorption of the 5-layered cushion structure having the air pools in accordance with the present embodiment. In this graph, the ordinate presents strength of shock (G) and the abscissa represents time necessary for absorbing shock (S).

As can be seen from FIGS. 9 to 11, given the shock of same strength, the shock is absorbed in a shorter time period by the 3-layered cushion structure than the single layered cushion structure. Further, it can be seen that the shock is absorbed in still shorter time period by the 5-layered cushion structure having air pools in accordance with the present embodiment than the 3-layered cushion structure.

Figure 12:
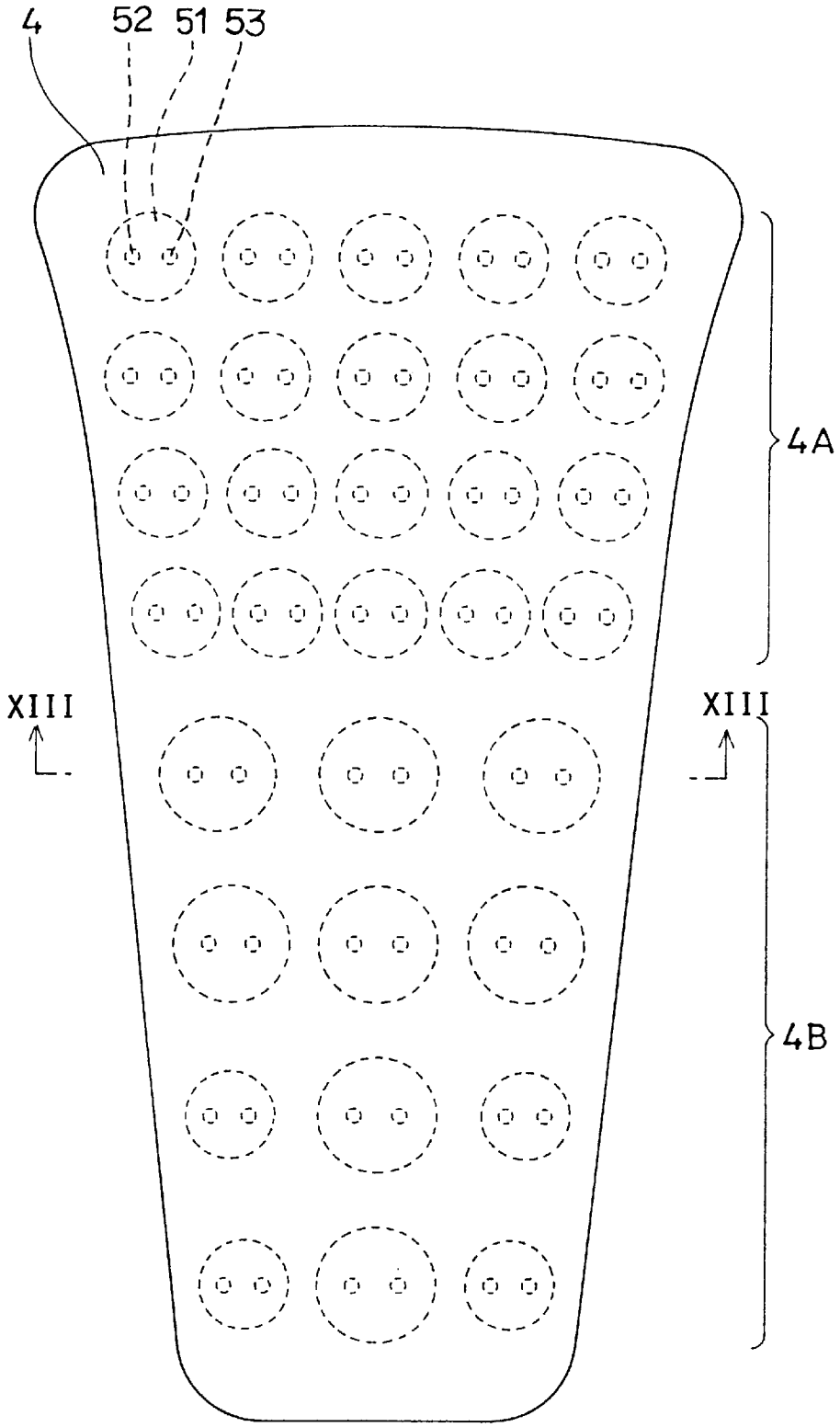
FIG. 12 is an illustration of a modification of the cushion structure in accordance with the present invention.

Though the cushion structure in accordance with the present embodiment applied to head guard 5 has been described with reference to FIGS. 5 to 8, the cushion structure of the present invention may be applied to backrest 4 of the safety seat of FIG. 5, as shown in FIG. 12. In this case, air pools 51 and outlet holes 52 and 53 are arranged concentrated in a region 4A at an upper portion of backrest 4, that is, the portion where the head of an infant rests. Thus it becomes possible to more effectively absorb the shock when the head of an infant hits, and hence the head (brain) of the infant can be sufficiently protected.

Figure 13:
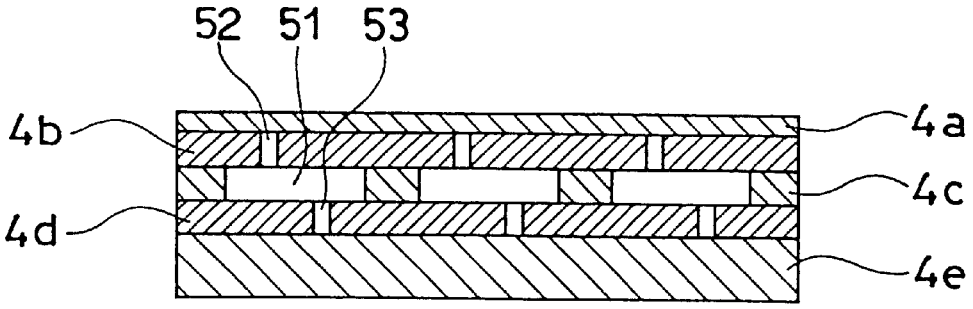
FIG. 13 is a cross section taken along the line XIII—XIII of FIG. 12.

Further, by providing air pools 51 and outlet holes 52 and 53 at prescribed intervals as shown in FIG. 12 in a region 4B where the back of an infant rests, effective shock absorption is possible. The cushion structure shown in FIG. 12 is similar to cushion structure shown in FIG. 7, as can be seen from FIG. 13. More specifically, the second and fourth cushion layers 4*b* and 4*d* are provided on both sides of the third cushion layer 4*c*, and the first and fifth cushion layers 4*a* and 4*e* are provided to sandwich the second and fourth cushion layers 4*b* and 4*d*.

Further, air pools 51 are provided at prescribed positions of the third cushion layer 4*c*, and outlet holes 52 and 53 apart from the central position of air pool 51 and offset from each other are provided in the second and fourth cushion layers 4*b* and 4*d*.

Because of the reasons described above and in view of air ventilation, soft polyurethane foam is used for the first, third and fifth cushion layers 4*a*, 4*c* and 4*e*, while hard polyethylene foam is used for the second and fourth cushion layers 4*b* and 4*d*.

Though a 5-layered cushion structure has been described as a preferable example of the cushion structure, shock absorption by air flow from air pool 51 described with reference to FIG. 8 can be attained by a 3-layered structure including the second, third and fourth cushion layers 5*b*, 5*c* and 5*d*, as shown in FIG. 7 dependent on the state of use.

Further, the cushion structure of the present invention may be implemented by a 4-layered structure, including a cushion layer formed of polyurethane foam only on one of the second and third cushion layers 5*b* and 5*c*.

As to the arrangement of air pools, the air pools may be provided only at positions where shock absorption is necessary, for example, at a position where the head of an infant touches. The arrangement may be changed dependent on the condition of use. The positions and numbers of outlet holes are not limited to the above described embodiment either, and the positions and numbers may be arbitrarily changed in accordance with the condition of use.

Though the effect of shock absorption is inferior, a 5-layered structure not having the air pools and outlet holes may be adopted.

Though the cushion structure applied to a vehicular child safety seat has been described as an example, similar shock absorption can be attained when the cushion structure is applied to a head protection pad for a vehicular child safety seat, baby carriage, a chair for an infant, a bed for an infant or a baby belt.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A cushion structure for a nursing equipment used for an infant, comprising first, second, third and fourth layers in this order from the side facing said infant, density of members constituting said first, second, third and fourth layers being selected such that densities of the second and fourth layers are higher than those of said first and third layers.

2. The cushion structure for a nursing equipment according to claim 1, further comprising a fifth layer on a back side surface of said fourth layer, density of a member constituting said fifth layer being lower than the density of the member constituting said fourth layer.

3. A cushion structure for a nursing equipment, comprising a shock absorbing structure including:

a first cushioning member forming a first layer that surrounds an air space containing an air pool therein; and a second cushioning member that forms at least one second layer surrounding said first layer;

wherein said first cushioning member has a lower density than said second cushioning member; and wherein said shock absorbing structure is so constructed and adapted to absorb a shock applied thereto by deforming said air space and said air pool while releasing air out of said air pool.

4. The cushion structure for a nursing equipment according to claim 3, wherein said shock absorbing structure includes an outlet hole communicated with said air pool.

5. The cushion structure for a nursing equipment according to claim 3, wherein said shock absorbing structure includes a cut out communicated with said air pool.

6. The cushion structure for a nursing equipment according to claim 3, wherein said first member comprises a porous material surrounding said air pool.

7. The cushion structure for a nursing equipment according to claim 3, wherein said first member consists of a layer of porous material surrounding said air pool.

8. A cushion structure for a nursing equipment supporting an infant from behind, comprising:

a first cushion member forming a first cushion layer;

a second cushion member forming a second cushion layer positioned behind said first cushion layer; and a third cushion member forming a third cushion layer positioned behind said second cushion layer; wherein:

said second cushion layer has an air pool within a prescribed air space therein; and said second cushion member has a lower density than said first and third cushion members.

9. The cushion structure for a nursing equipment according to claim 8, wherein said second cushion member is softer than said first and third cushion members.

10. The cushion structure for a nursing equipment according to claim 8, wherein at least one of said first and third cushion members has an outlet hole therein communicated with said air pool.

11. The cushion structure for a nursing equipment according to claim 6, wherein said outlet hole is located apart from a central region of said air pool.

12. The cushion structure for a nursing equipment according to claim 10, comprising a plurality of said air pools and a plurality of said outlet holes, wherein said air pools and said outlet holes are provided at an area supporting the head of an infant supported on said nursing equipment.

13. The cushion structure for a nursing equipment according to claim 8, wherein said first and third cushion members have outlet holes therein communicated with said air pool, said outlet holes are located apart from a central region of said air pool, and said outlet holes in said first and third cushion members are offset from each other.

14. The cushion structure for a nursing equipment according to claim 8, further comprising a fourth cushion layer softer than said first cushion layer arranged on a front surface of said first cushion layer.

15. The cushion structure for a nursing equipment according to claim 14, further comprising a fifth cushion member forming a fifth cushion layer arranged on a back surface side of said third cushion layer, wherein said fifth cushion member has a lower density than said third cushion member.

* * * * *

UNITED STATES PATENT AND TRADEMARK OFFICE

CERTIFICATE OF CORRECTION

PATENT NO. : 6,257,237 B1
DATED : July 10, 2001
INVENTOR(S) : Sachiyo Suzuki

It is certified that error appears in the above-identified patent and that said Letters Patent is hereby corrected as shown below:

Column 4,
Line 5, after "(", replace "principle" by -- Principle --.

Column 8,
Line 29, after "claim", replace "6," by -- 10, --.

Signed and Sealed this

Twenty-first Day of May, 2002

*Attest:*

*Attesting Officer*

JAMES E. ROGAN
*Director of the United States Patent and Trademark Office*